United States Patent [19]

Brannon

[11] 4,138,119

[45] Feb. 6, 1979

[54] CARD-TYPE GAME AND APPARATUS FOR PLAYING SAME

[76] Inventor: Jeanetta H. Brannon, 618½ E. 97th St., Inglewood, Calif. 90301

[21] Appl. No.: 853,081

[22] Filed: Nov. 21, 1977

[51] Int. Cl.[2] ..... A63F 3/00

[52] U.S. Cl. ..... 273/236; 273/1 R; 273/148 A

[58] Field of Search ..... 273/148 A, 236, 271, 273/272, 273, 274, 299, 303, 306, 309

[56] References Cited

U.S. PATENT DOCUMENTS

| | | | |
|---|---|---|---|
| 952,939 | 3/1910 | Parker | 273/303 |
| 3,011,789 | 12/1961 | Eliassen | 273/236 X |
| 3,759,521 | 9/1973 | Breslow | 273/148 A X |
| 3,921,982 | 11/1975 | Feldman | 273/274 |

*Primary Examiner*—Harland S. Skogquist

[57] ABSTRACT

This invention relates to a card-type game, called Pot Luck, and apparatus for playing same, that generally utilizes a playing board, simulated money and three decks of cards, one deck being the playing cards. The playing cards are composed of four suits with each suit having a combination of sequentially numbered cards and alphabetic lettered cards of common words. The game tests the mental agility and manual dexterity of the players in stacking the numerical and alphabetical lettered cards in a pre-arranged order. The game may be played by up to eight people of any age combination of approximately 5 years, and older and may be adapted to develop spelling and counting skills.

9 Claims, 5 Drawing Figures

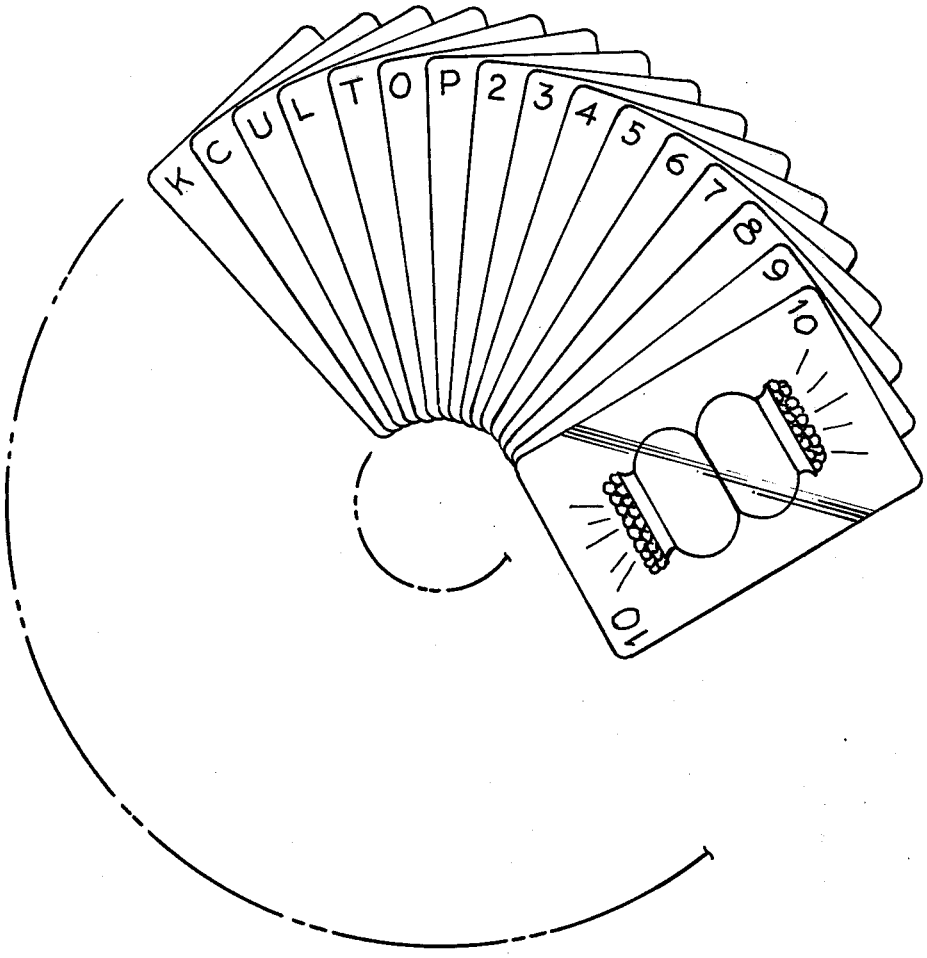
Fig. 2
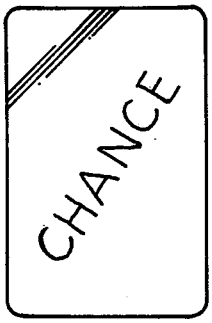
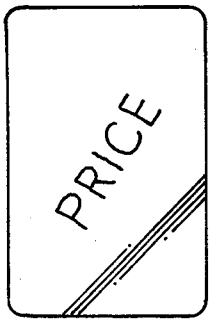
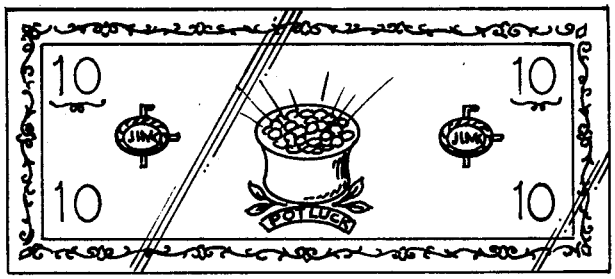
Fig. 3
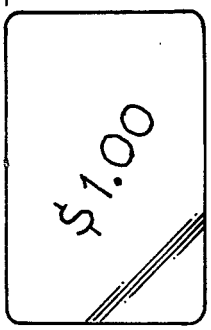
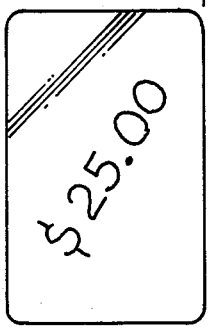
Fig. 4
Fig. 5

CARD-TYPE GAME AND APPARATUS FOR PLAYING SAME

BACKGROUND OF INVENTION

Heretofore conventional card games have primarily been designed with the objective of attaining a particular combination of cards based upon their numerical value, or their suits. This has resulted in the players being restricted to various levels of expertise and intelligence, depending upon the particular game. Conventionally, each player is given a reasonable time to consider and make his play before the play shift to the next player, in a systematic rotation. Accordingly, conventional playing cards, heretofore, are designed for the more sophisticated players with suit identifications by distinguishing marks, rather than by color, that tends to confuse players of tender ages and mentalities. Also, their short attention spans cause a loss of interest when a card game, in which they are participating, becomes too slow or the rules become too complex. Thus, conventional type card games tend to lack the action, or movement, that will create and maintain enthusiasm in these young players. Lastly, conventional card-type games, to the inventor's knowledge, do not provide a vehicle by which spelling and counting skills may be developed.

SUMMARY OF INVENTION

One object of this invention is to provide a stimulating card-type game, playable with two to eight players, that may be enjoyed by persons of 5 years and older.

Another object of this invention is to provide a card-type game that requires both mental agility and manual dexterity to win.

A yet further object of this invention is to provide a family game, of the card-type, in which the younger members of the game can play at a par with the adult members, without requiring their indulgence.

A still further object of this invention is to provide a card-type game that may be utilized as an educational vehicle to teach such skills as number and alphabetic letter recognition, counting, and spelling.

Other objects of this invention will become apparent in the drawings and detail specifications appended hereto, and also are incorporated into the scope of this invention.

DESCRIPTION OF THE DRAWINGS

FIG. 2 shows a typical suit of playing cards having both numbers and alphabetic letters.

FIG. 3 is a typical money bill.

FIG. 4 is a typical chance card.

FIG. 5 is a typical price card.

DESCRIPTION OF THE PREFERRED EMBODIMENT

Figure 1:
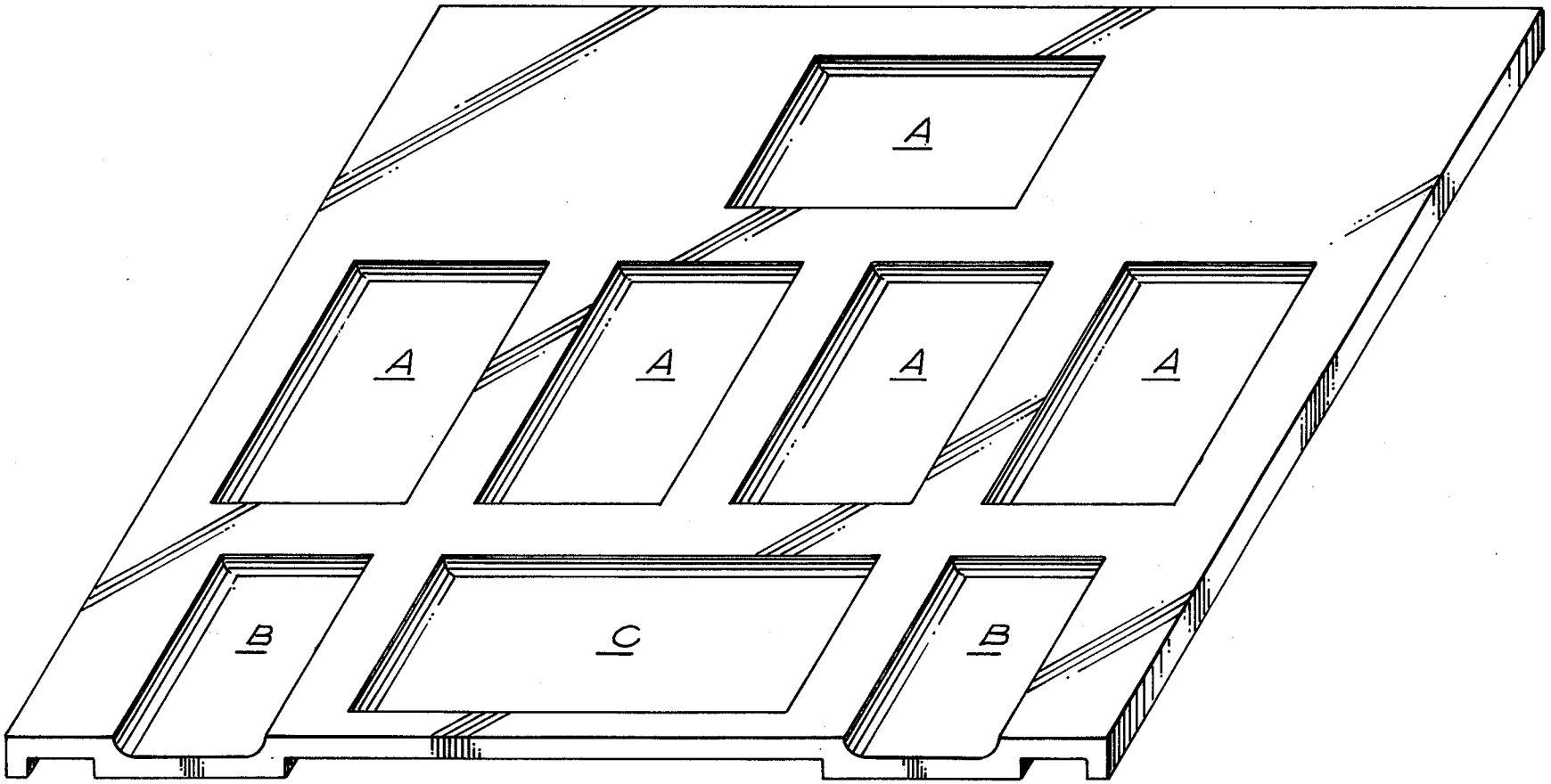
FIG. 1 shows the game board with recesses for receiving cards of the various decks and simulated money bills.

Three sets of playing cards are required for this game as shown in FIGS. 2, 4 and 5, correspondingly identified herein as the playing cards, the chance cards and the price cards.

FIG. 2 shows one of four suits of playing cards required for this game. The faces of all cards in a particular suit have a common color to distinguish them from cards in the other suits. In my invention I have identified the four suits by the colors green, blue, red and orange. As will be discussed subsequently, this color combination is an important feature of this invention and is similarly utilized in the four suits of the chance cards as illustrated in FIG. 4. This is not to say, however, that the suits of each card could not be identified by other means other than color, such as conventional markings. However, I have utilized a distinctive color for each suit so as to enable players of young ages, as low as five years, and low mentalities to participate since these persons are able to recognize and comprehend colors much easier than identifying marks. Other than the color designations described above, the suits of playing cards are identical in all other respects. Again, as represented in FIG. 2, each card in a suit of the playing cards, is identified by either a number or a letter. The cards identified by numbers are 2 through 10, inclusive, while each of the other cards in the suit is identified by a letter of the two words "pot luck." Although I have used the letters of the words "pot luck" to supplement the numbers in the playing cards the letters of other words would be equally appropriate. By way of example, the game could be provided with independent sets of lettered cards, colored for each suit, so that other words would replace "pot luck" and thus, as will become evident, develop spelling skills. Likewise, independent sets of numbered cards could be provided, for each suit, to develop different sequences, and thus, as will also become evident, develop counting skills. For more advanced players, difficult words and numbering sequences could be utilized, whereas more common words, and single digit sequences would be used with the young players. As noted in FIG. 2, the cards follow a progression of ascending and descending order. That is to say, the cards ascend in numerical value from 2 through 10, inclusive, and then descend back to 2 in the reverse spelling order of the words, "pot luck." Thus, each card, either numerically or alphabetically, is sequenced between two other cards. This sequence is followed in the play of this game so that only these two cards may be played upon the card in the middle. This sequence is maintained throughout the game. As mentioned previously, the suits could be changed by different series of numbers or letters for subsequent games. The price cards are smaller than the playing cards, being approximately 2½ inches by 1½ inches and are shown in FIG. 3. As with the playing cards, there are four suits of price cards, being identical in all respects except that each suit is distinguished by a different color, as with the playing cards, i.e., blue green, red or orange. A complete suit of price cards will have each card bearing one of the following monetary denominations: $300, $400, $500, $1,000, $5,000, $10,000, $20,000, $50,000 and $100,000.

The chance cards, being the same size as the price cards, are provided without any color identification as to suit, with a plurality of cards indicating each of the following monetary denominations: one-dollar, five-dollars, $10, $20, $50, and $100.

The simulated money bill is shown in FIG. 3 for a typical $10 bill. A convenient number of simulated money bills are provided in the following denominations: one-dollar, five-dollars, $10, $20, $50, $100, $500, $1,000, $50,000, and $100,000. I have found that the following quantities of each denomination provide an adequate reserve without requiring any change in the games rules: 120 one-dollar bills, 56 five-dollar bills; 40-$10 bills; 80-$20 bills; 32-$50 bills; 40-$100 bills;

32-$500 bills; 16-$1,000 bills; 16-$5,000 bills; 16-$10,000 bills; 16-$20,000 bills; 16-$50,000 bills; and 10-$100,000 bills.

The board on which this game is played is shown in FIG. 1. As indicated the board has recesses A, B, and C being approximately one-half inch with rounded sides for convenient placement and removal of the cards and money bills. The recesses designated by the letter A are for the playing cards, the recesses identified by the letter B are for the price cards and the chance cards, and the recesses designated by the letter C are for the money bills. The playing board may be made of any suitable material in which the described recesses may be produced by cutting, molding or any other conventional means. In my preferred embodiment I have utilized a plastic game board wherein the recesses have been molded. As will be noted the sides of the recesses are rounded so as enable the cards and money bills to be easily withdrawn without the obstruction of sharp corners and edges. Conversely, the card and money bills may be easily and quickly placed in the recesses without requiring precise pre-positioning.

To commence the game each of the three decks of cards previously described, is shuffled and the price and chance decks are each placed face down in one of the recesses B. The banker is then selected by each player drawing a card from the playing deck. The player drawing the card with the highest value is the banker. The values of the cards are in ascending order starting with the lowest numbered card, being the number 2 in the preferred embodiment, and continuing sequentially through the number cards to the highest card, which will be the letter card of the first letter in the first word, i.e., the letter "P" in the preferred embodiment. If two or more players draw cards having equal values, these players will make additional draws until one succeeds in drawing the highest card. The banker then distributes an equal sum of money to the participating players. Up to eight players may conveniently play this game. However, in the preferred embodiment, the game board was designed for up to four players. If more than four players participate, either an additional game board may be utilized or the additional players may play along side of a single game board.

The banker has the option of either playing or not playing. After this election, he draws a card from the price deck, which had previously been placed face down in one of the recesses B, of FIG. 1. The color of the face of the card drawn indicates the classification of the "Pot," i.e., whether a blue pot, a green pot, an orange pot, or a red pot, and the price indicated on that card is what each player must pay the banker to enter the game. The money given the banker is kept in recess C of FIG. 1. If the price card drawn is blue or green, a tax rebate is given to the winner at the end of the game, i.e., $150 if the price card drawn is blue and $100 if the price card drawn is green. Conversely if the price card drawn is either red or orange, the winner must pay a tax to the banker of $150 if the price card is red and $100 if the price card is orange.

Next the banker deals each player up to 10 cards from the playing deck. Ten cards each if there are four, or fewer players and less then ten cards if there are more than four players. The banker then places face down a single card in the recesses A, or along side the playing board, equal to the number of players. That is, for two players, two cards would be placed face down in each of two recesses A, for three players, three cards would be placed face down in each of three recesses A, and etc. For five players, four cards would be placed face down in each of the four recesses A and an additional card either placed face down along side the playing board or in a fifth recess A of a second playing board. The remaining cards are placed face down in a vacant recess A on the game board, or placed along side the game board if four, or more players are participating.

Each player may then pick up any three cards from those dealt him, and will place one hand upon one of the cards dealt face down in the recesses A or along side the game board. At no time during the game may a player hold more than three cards in his hand and only the cards held in the hand may be played. After a card has been played, another card is picked up from those dealt, in any order desired by the respective players, to bring the total number of hand-held cards to three.

The banker then calls out the word "Go" and each player immediately flips face up the card that his hand is on in one of the recesses A, as along side the playing board.

Any player may now play upon any of the cards that have now been turned face up. The objective being to independently play the hand-held cards, face up, upon these cards and the cards subsequently played upon them as rapidly as possible. Each player can play as rapidly as he can without waiting for the other players. The player first to play all cards dealt him is the winner. In a tie, the card on the bottom prevails.

The important rule of play always being that only a card may be played coming immediately before, or after, the card appearing face-up on any of the stacks that developed on the original cards that were turned face-up at the beginning of the game. Each player may play upon any of these stacks as rapidly as his mental agility and manual dexterity will allow. The order of the cards is as indicated in FIG. 2, and previously described. Thus, it becomes obvious that after a card has been played face-up upon one of the original cards that was flipped over, in one of the recesses A or along side the playing board, the third card may be played face-up upon the second card, and likewise for the fourth, fifth, and etc.

After a player has played all his cards, he must call out "Pot Luck" before any of the other players. Thus, it becomes obvious that since the game is a race, not only must the player play all of his cards, he must also announce that he was the first to do so by this call out.

The winner takes the money deposited with the banks after the price card was drawn. However, he is either taxed, or receives a tax rebate, depending upon the type of pot. Thus, for a "blue pot" he receives a $150 tax rebate from the banker; for a "green pot" he receives a $100 tax rebate from the banker; however, for a "red pot" he pays a tax to the banker of $150; and for an "orange pot" he pays a tax to the banker of $100. The tax, and the tax rebate, does not come out of the pot, but either increases or decreases the bankers money. If a deadlock develops, where none of the players can play upon any of the cards in the recesses A, or along side the playing board, the banker, if playing, will draw a card from the chance deck which has been placed face down in a recess B. He must contribute to the pot the amount indicated on that card to remain in the game. If the banker is not playing, the player to his immediate left draws the chance card and must contribute to the pot the amount indicated to remain in the game.

After the deposit has been made to the pot, the banker, or the player to his left that drew the chance card, will draw a card from the play deck and display it face-up before all of the players. He has the first opportunity to use that card, with any of his other cards, to make a play and get the game back into play. If he is unable to do so the turn shifts to the person to his left, and so on until play resumes.

When the play stops a second time the process is repeated with the turn passing to the next player to the left. Similarly if none of the players can use the card drawn, the process also is repeated with the turn passing to the next player on the left.

Players that run out of money may borrow from the banker. However, all sums borrowed must be repaid to the banker at the end of the game.

Although in my preferred embodiment I have selected a deck of cards, identified herein as the "chance deck" to provide the means for determining the amount a player must contribute to stay in the game, other conventional means could also be utilized. By way of example, a wheel having radial sections, with each section bearing a different monetary amount, and a pointer superimposed and rotatable about the wheel; or visa versa, the wheel rotatable about the pointer. Thus, the wheel, or pointer, is spun and then allowed to spin freely and stop at a location that designates a particular amount. Still other conventional techniques could be utilized.

A variation of the principle embodied in this invention is to play numerical cards and letter cards together, such as in the following manner: the dealer deals to each player, from the playing deck seven cards. After the deal has been made, the dealer has the option of calling one of three possible games, i.e., "Spread," "Spell" or "Spread and Spell." If the game is announced as spread, each of the players will attempt to obtain seven cards in any sequential numerical order to win. Similarly, if the game is declared as "spell" the object will be to spell the words "Pot Luck" to win. If the game is declared by the dealer, as "spread and spell," the object of the game will be for each of the players to select whether they want to "spread," or to "spell." The player first to achieve either the words "Pot Luck," or a sequential range of numbers, is the winner.

Cards are selected and discarded as follows: the player to the immediate left of the dealer begins the play by drawing one card from the top of the reserve cards, and then discarding one of his cards face-up on the table. The player to his immediate left has the option of picking up the discarded card and then discarding one of his other cards. Or alternatively, he may select a card from the deck and then discard one of his cards upon the previously discarded card. The player then to his immediate left may play his discarded card, or may select a new card from the deck, after which he too discards a card, etc.

It is clear that the embodiment of the invention which has been described is only illustrative of one way my invention may be practiced. It may be changed in many ways, some of which have been indicated, and as such, these changes do not affect the essence of my invention as described in the annexed claims.

I claim:

1. A game apparatus, which comprise:

(a) a first deck of playing cards, having a plurality of suits, in which each suit contains cards bearing the same sequential numbers and cards bearing the same alphabetic letters;

(b) a second deck of cards, having a plurality of suits and in which each suit contains cards designating various monetary denominations;

(c) chance means for selecting one monetary amount from multiple possibilities;

(d) a plurality of simulated money bills of various monetary combinations corresponding to the monetary denominations displayed on the individual cards of the second deck; and (e) a playing board having a plurality of first designated locations for receiving cards from the first deck of playing cards, a second designated location for receiving the second deck of playing cards, a third designated area for receiving the chance means, and a fourth designated location for receiving the simulated money bills.

2. Game apparatus as defined in claim 1, wherein the chance means for selecting one monetary amount from multiple possibilities, comprise a third deck of cards with each card bearing a different monetary value.

3. Game apparatus as defined in claim 1 wherein the first deck of playing cards contained four suits, with the faces of all cards in each suit being a common color distinctive from the colors of the faces of the cards of other suits.

4. Game apparatus as defined in claim 1 wherein the second deck of playing cards contained four suits, with the the faces of the cards in each suit being a common color distinctive from the colors of the faces of the cards of the other suits.

5. Game apparatus as defined in claim 1, wherein the first, second, third and fourth locations on the playing board have been recessed below the surface of the playing board for easy placement and removal of the playing cards.

6. Game apparatus as defined in claim 1, wherein the pre-arranged order of the alphabetic letters of the first playing cards spell a word.

7. Game apparatus as defined in claim 6, wherein the alphabetic letters combine to spell the word "Pot Luck."

8. Game apparatus as defined in claim 3, wherein the colors identifying the four suits are red, orange, green and blue.

9. Game apparatus as defined in claim 4, wherein the colors designating the four suits are orange, red, blue and green.

* * * * *